United States Patent [19]

Smalley

[11] 4,341,318

[45] Jul. 27, 1982

[54] CLOSURE WITH CHILD-RESISTANT TAMPER-PROOF BAND

[75] Inventor: Ned J. Smalley, Perrysburg, Ohio

[73] Assignee: Owens-Illinois, Inc., Toledo, Ohio

[21] Appl. No.: 246,814

[22] Filed: Mar. 23, 1981

[51] Int. Cl.[3] ..... B65D 55/02

[52] U.S. Cl. ..... 215/225; 215/211; 215/216; 215/256

[58] Field of Search ..... 215/211, 216, 224, 225, 215/256

[56] References Cited

U.S. PATENT DOCUMENTS

| | | | |
|---|---|---|---|
| 4,066,181 | 1/1978 | Robinson et al. | 215/256 |
| 4,261,478 | 4/1981 | Summers | 215/216 |
| 4,281,774 | 8/1981 | Mumford | 215/256 |

*Primary Examiner*—George T. Hall

*Attorney, Agent, or Firm*—John R. Nelson; Myron E. Click; David H. Wilson

[57] ABSTRACT

A child-resistant closure includes a tamper-proof band which engages an associated container finish, and which must be separated from the remainder of the closure for removal of the closure from the finish. A pull tab and weakening grooves are provided to permit manual separation of the tamper-proof band from the remainder of the closure. A resilient shield integrally formed with the tamper-proof band overlies the pull tab and normally prevents grasping thereof. Removal of the closure is possible only when the shield is manually deflected and held in position while the pull tab is grasped and the tamper-proof band torn away from the remainder of the closure.

5 Claims, 3 Drawing Figures

CLOSURE WITH CHILD-RESISTANT TAMPER-PROOF BAND

BACKGROUND OF THE INVENTION

1. Field of the Invention

The invention relates to an improvement in tamper-proof closures, in particular, those closures having an annular, frangible tamper-proof band depending from the lower annular edge of the closure skirt and including a pull tab to facilitate removal of the tamper-proof band.

2. Description of the Prior Art

Tamper-proof closures have long been in use. The typical tamper-proof closure comprises a disc shaped panel, and an annular skirt depending from the periphery thereof. An annular tamper-proof band is attached by frangible means to the lower annular edge of the skirt. The tamper-proof band is adapted to engage an associated container finish, by any of several known means. For example, U.S. Pat. No. 3,980,195 to Fillmore discloses a closure including a tamper-proof band having inwardly projecting teeth engaging complementary outwardly projecting lugs on the container finish, to prevent rotational removal of the tamper-proof closure. Alternately, the tamper-proof band may engage an outwardly projecting bead formed on the container finish, either by being heat-shrunk onto the bead, or by being snapped into engagement with the bead.

In one type of tamper-proof closure, the band engages the container finish firmly enough to prevent removal of the closure while the tamper-proof band is still intact. To remove the closure, the tamper-proof band must first be removed from the closure skirt by tearing the frangible attachment means. The condition of the tamper-proof band will therefore provide a clear visual indication of whether the closure has been removed and reapplied, or whether an attempt has been made to tamper with the container. To facilitate removal of the tamper-proof band, these closures include a pull tab integrally formed on the tamper-proof band, by which the tamper-proof band can be grasped and removed.

Such tamper-proof closures therefore require two sequential operations by the user: first the removal of the tamper-proof band, then the removal of the closure itself, either by unscrewing or unsnapping the closure. However, these operations are not sufficiently complex for such closures to be regarded as child-resistant. Yet it is desirable to package many products in containers which have both a child-resistant feature and a tamper-proof or tamper indicating feature.

SUMMARY OF THE INVENTION

It is, therefore, an object of the invention to provide a tamper-proof closure which is child-resistant by virtue of means which require relatively complex manipulations to effect the removal of the tamper-proof band. The closure includes resilient means which shield the pull tab and normally prevent grasping thereof to effect removal of the tamper-proof band.

A closure embodying the present invention comprises a top panel section, and an integral, annular skirt depending from the periphery thereof. The inside annular surface of the skirt includes a circumferential groove formed therein, adapted to engage a locking bead which projects outwardly from an associated container finish. The inside annular surface of the skirt tapers downwardly and outwardly below the circumferential groove, to facilitate application of the closure to the container finish. When the locking bead engages the circumferential groove, removal of the closure is normally impossible while the closure skirt remains intact. The circumferential groove provides a weakening line along which the lower portion of the skirt can be torn from the remainder of the closure. The lower portion of the skirt, below the circumferential groove, therefore functions as a tearable tamper-proof band, which must be separated from the closure to allow removal of the closure from the associated container.

An associated container finish normally includes an outwardly projecting shoulder spaced only slightly below the lower annular edge of the tamper-proof band of the applied closure. Hence a consumer cannot grasp the lower edge of the tamper-proof closure in order to tear it from the remainder of the closure. Therefore, a pull tab is provided which is integral with the tamper-proof band and projects radially therefrom. An axial weakening groove is formed in the tamper-proof band adjacent the pull tab, whereby the tamper-proof band is split when the tab is pulled. The closure is rendered child-resistant by shield means, which are provided to prevent grasping of the pull tab by a child. An integral bridge extends radially outwardly from the tamper-proof band, beyond the end of the pull tab. The bridge supports a resilient, shielding flap which extends circumferentially over the end of the pull tab. To remove the tamper-proof band, the resilient flap must be manually deflected outwardly, and held in this position while the pull tab is grasped, and the tamper-proof band removed.

DESCRIPTION OF THE PREFERRED EMBODIMENT

Figure 2:
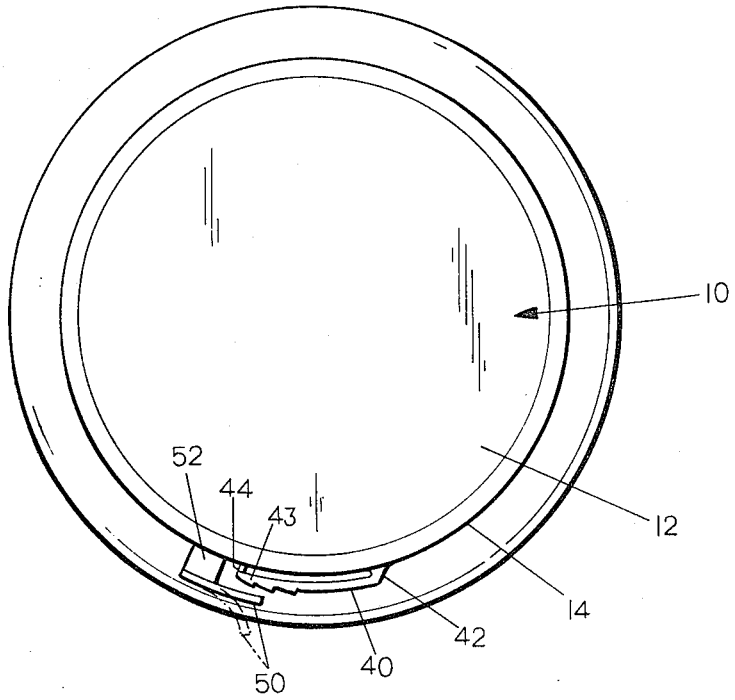
FIG. 2 is a top plan view of the closure and container of FIG. 1.
Figure 1:
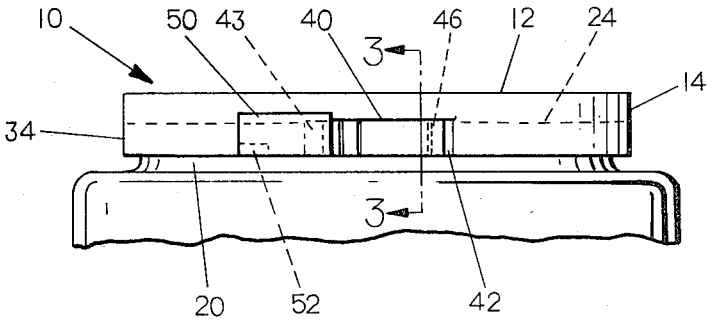
FIG. 1 is a side elevational view of a closure embodying the present invention, shown in sealing engagement with an associated container finish.

A tamper-proof closure 10 embodying the present invention comprises a circular top panel section 12 and an annular skirt 14 depending from the periphery thereof. An annular plug 16 depends from the inside surface of the panel 12, and is constructed and arranged to sealingly engage the inside annular surface 18 of an associated container finish 20.

The container finish 20 includes an outwardly projecting annular snap bead 22, formed adjacent the annular rim of the finish 20. A cooperating circumferential groove 24 is formed in the inside annular surface of the skirt 14, and is constructed and arranged to receive the outwardly projecting snap bead 22.

Figure 3:
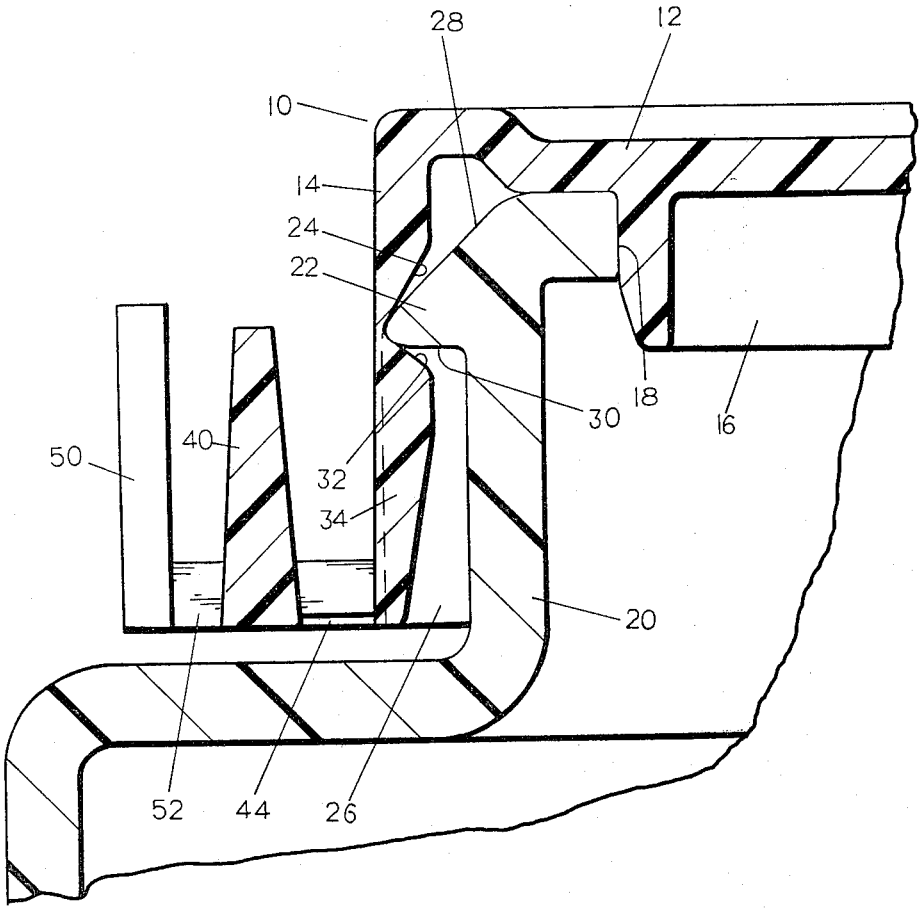
FIG. 3 is an enlarged scale sectional elevational view taken on the line 3—3 of FIG. 2.

The inside annular surface 26 of the skirt 14 below the circumferential groove 24 tapers downwardly and outwardly. The upper surface 28 of the snap bead 22 also tapers downwardly and outwardly. During application of the closure 10 to the container finish 20, the sliding engagement of the tapered surfaces 26 and 28 facilitates the circumferential stretching of the skirt 14 around the snap bead 22. As the closure 10 is pushed into final position on the finish 20, the snap bead 22 snaps into locking engagement with the groove 24. In the sealing position shown in FIG. 3, the downwardly facing horizontal surface 30 of the bead 22 and the upwardly facing surface 32 of the groove 24 interfere to prevent removal of the closure 10 from the container finish 20 by a simple upward force. The lower portion of the skirt 14, below the circumferential groove 24, therefore functions as a tamper-proof band 34. The tamper-proof band 34 must be separated from the remainder of the skirt 14 to permit removal of the closure 10. The circumferential groove 24 provides a weakened circumferential line along which the tamper-proof band 34 can be torn.

An integral pull tab 40 is provided to facilitate removal of the tamper-proof band 34. The tab 40 is slightly spaced from the outside surface of the tamper-proof band 34, and extends circumferentially through an arc of approximately 30°. One circumferential end 42 of the pull tab 40 is integrally and relatively rigidly attached to the tamper-proof band 34. The other end 43 is integrally attached to the tamper-proof band 34 only by a narrow, frangible bridge 44. An axial weakening groove 46 is formed in the tamper-proof band 34 adjacent the end 42 of the pull tab 40. To remove the tamper-proof band 34, the pull tab 40 must be grasped and pulled away from the tamper-proof band 34, thereby breaking the bridge 44 and splitting the tamper-proof band 34 along the axial line weakened by the groove 46. The tamper-proof band 34 can then be stripped away from the closure 10 along the line weakened by the circumferential groove 24.

Grasping of the pull tab 40 is normally prevented, however, by a resilient, flexible, shielding flap 50. The flap 50 is integrally attached to the tamper-proof band 34 by a bridge 52. The bridge 52 is spaced circumferentially from the end 43 of the tab 40 and extends radially beyond the outward extent of the pull tab 40. The flap 50 extends circumferentially to overlie the end 43 of the pull tab 40. Therefore, the flap 50 interferes with manipulation of the pull tab 40. The remove the tamper-proof band 34, the flap must be manually deflected while the pull tab 40 is pivoted radially outwardly to begin the tearing operation, as illustrated in phantom line in FIG. 2.

The closure 10 is preferably injection molded from a thermoplastic material. A preferred material, having appropriate resiliency, is high density polyethylene.

The invention thus provides a child-resistant feature for closures requiring tamper-proofing means. As the child-resistant feature is destroyed with removal of the tamper-proof band, the closure is intended for products which are consumed in a single use.

Modifications of the invention will be apparent to those skilled in the art, and it is therefore intended that the scope of the invention be determined solely by the appended claims.

What is claimed is:

1. A child-resistant, tamper-proof closure comprising a panel section; an annular skirt depending from the periphery of said panel, the lower portion of said skirt including a tamper-proof band removably attached to the remainder of said skirt; means on said tamper-proof band for engaging the finish of an associated container to prevent removal of the closure while the tamper-proof band is attached to the remainder of the closure, grasping means on said skirt to facilitate removal of said tamper-proof band; and shield means integrally formed with said closure for normally preventing access to said grasping means, said shield means being manipulable to permit such access.

2. The closure defined in claim 1 wherein said grasping means includes a pull tab outwardly projecting from said tamper-proof band.

3. The closure as defined in claim 1 or 2 wherein said shield means comprises a resilient flap overlying said grasping means to prevent grasping thereof, said flap being manually deformable to expose said grasping means.

4. The closure as defined in claim 1 wherein said means on said tamper-proof band for engaging the container finish includes a circumferential groove formed on the inside annular surface of said skirt.

5. The closure defined in claim 1 or 2 wherein said shield means includes a flexible, resilient flap integrally connected to said tamper-proof band by a radially projecting bridge spaced from said grasping means, said flap extending circumferentially from said bridge to overlie at least a portion of said grasping means.

* * * * *